United States Patent [19]

Reed

[11] 4,327,804

[45] May 4, 1982

[54] GEOTHERMAL WELL HEAD ASSEMBLY

[75] Inventor: Leaman T. Reed, Bakersfield, Calif.

[73] Assignee: Midway Fishing Tool Co., Bakersfield, Calif.

[21] Appl. No.: 139,824

[22] Filed: Jul. 31, 1980

[51] Int. Cl.[3] ..... E21B 33/03; F16L 19/00; F16L 55/00

[52] U.S. Cl. ..... 166/97; 166/84; 166/86; 166/88; 285/187; 285/302

[58] Field of Search ..... 166/97, 82, 84, 86, 166/88, 89; 285/302, 187

[56] References Cited

U.S. PATENT DOCUMENTS

| | | | |
|---|---|---|---|
| 1,598,794 | 9/1926 | Warren | 166/89 |
| 1,875,793 | 9/1932 | Young et al. | 166/89 |
| 2,187,839 | 1/1940 | Penick et al. | 166/89 X |
| 2,323,179 | 6/1943 | Hall et al. | 285/302 X |
| 2,610,689 | 9/1952 | Eckel | 166/89 X |
| 2,954,742 | 10/1960 | Williams | 166/84 X |
| 3,976,130 | 8/1976 | Chambless et al. | 166/84 |

*Primary Examiner*—Stephen J. Novosad

*Attorney, Agent, or Firm*—William C. Babcock

[57] ABSTRACT

A valved assembly capable of being removably mounted on a geothermal well head from which a first casing extends downwardly and is cemented in a bore hole. A second casing of smaller external diameter than that of the interior diameter of the first casing extends downwardly to the hot fluid producing zone, and is concentrically disposed within the first casing. The assembly is characterized by first and second groups of resilient sealing rings, so disposed that longitudinal contraction and expansion of the second casing string may take place without the seal between the interior of the assembly and the ambient atmosphere being disrupted. Single manually operated means are provided on the assembly for forcing the first group of resilient rings into compressive slidable sealing contact with the exterior surface of the second casing to effect a primary seal, and concurrently this force being transferred to the second group of rings to force them into radial sealing engagement with a downwardly and inwardly tapering section of the first casing to define a secondary seal.

2 Claims, 3 Drawing Figures

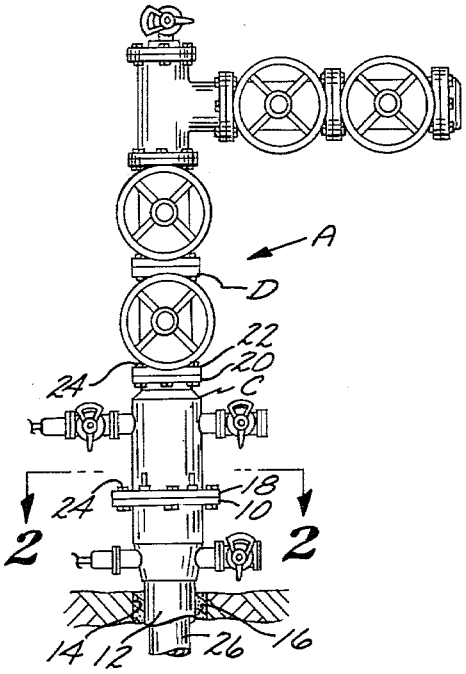
FIG. 1
FIG. 2
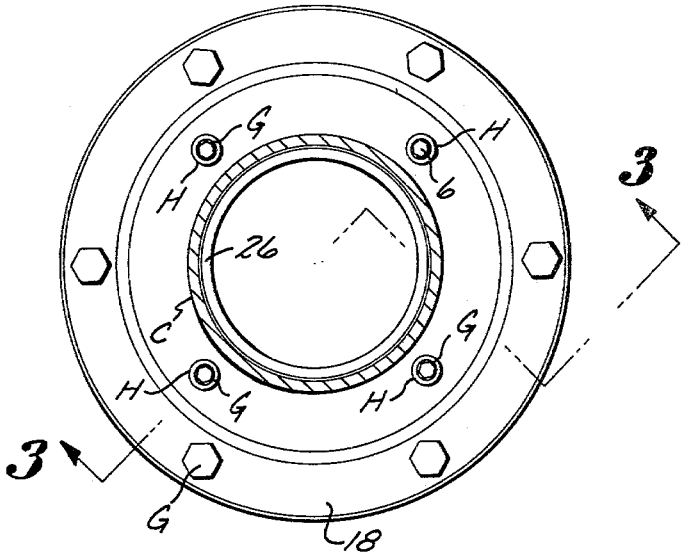
FIG. 3
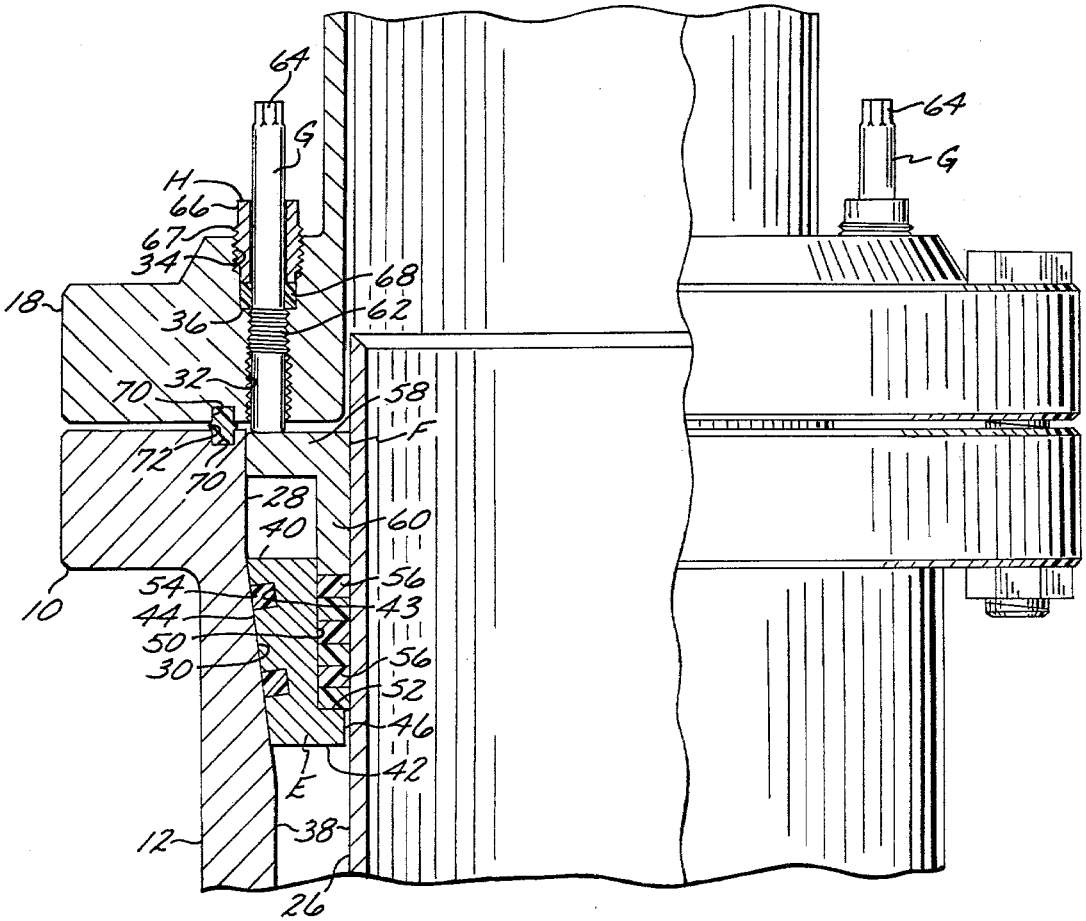

GEOTHERMAL WELL HEAD ASSEMBLY

BACKGROUND OF THE INVENTION

1. Field of the Invention

Geothermal Well Head Assembly.

2. Description of the Prior Art

In recent years, due to the uncertainty of petroleum and natural gas as a source of energy, the production of power from geothermal wells has taken on increased importance. A troublesome problem in the production of geothermal energy, is maintaining a seal at the well head between the ambient atmosphere and the interior of the valved manifold through which the heated fluid from the geothermal zone flows. The difficulty in so maintaining a seal is due to the substantial longitudinal expansion and contraction that takes place in the casing or tubing string through which heated fluid flows relative to the stationary well head assembly. In the past it has been common practice to employ multiple groups of resilient rings to effect a seal to allow for such expansion and contraction, with the groups of rings having the same force exerted thereon to radially expand the same. Such a mode of sealing has been found unsatisfactory in that there was no correlation between the forces exerted on the two groups of resilient rings, and as a result an excessive force could be exerted on one group and an insufficient force on the other group.

A major object of the present invention is to supply a geothermal well head assembly that allows longitudinal expansion and contraction of the string of casing or tubing operatively associated therewith and that extends to a fixed position relative to the producing zone without the operational disadvantages of prior art devices of this nature, and one in which a single force producing mechanism operated from the exterior of the well head assembly deforms a first group of resilient rings into slidable sealing contact with the hot fluid carrying string and concurrently the same force moves a second group of resilient rings that provide a secondary seal downwardly relative to a downwardly and inwardly tapering surface to effect a seal therewith.

Another object of the invention is to provide a geothermal well head assembly that is simple and easy to use, and one that requires the actuation of but a single force producing mechanism to place the assembly in a condition where there is no undesired communication between the ambient atmosphere and the interior of the assembly.

Yet another object of the invention is to supply a geothermal well head assembly that is of simpler structure than prior art devices of this nature, and one that requires a minimum of maintenance attention.

Yet another object of the invention is to provide a geothermal well head assembly in which the first and second sealing rings may periodically have the compressive force exerted thereon adjusted manually from the exterior of the assembly without shutting down the well by pumping mud down the bore hole. After such a shut down the well may not return to its original productivity, and in some instances be killed due to the mud impregnating the geothermal zone.

SUMMARY OF THE INVENTION

The geothermal well head assembly of which the present invention forms a part includes a first flange that is located on the upper extremity of a first casing that is cemented in and extends down a well bore to communicate with a heated fluid producing zone. The assembly also includes a spool that has second and third flanges on the ends thereof. A valved manifold is provided that has a fourth flange on the lower end thereof. A number of bolts removably secure the second flange to the first flange, and the fourth flange to the third flange. A second casing that has an upper end is so disposed that the upper end extends above the first flange. The second casing has an external diameter that is substantially smaller than the interior diameter of the first casing in which it is disposed, and the two casings defining an annulus space therebetween. The second casing has the lower end thereof in communication with the heated fluid producing zone.

The geothermal well head assembly of the present invention allows the second casing to expand and contract longitudinally due to variations in the temperature thereof, and this expansion and contraction taking place while a primary and secondary seal is maintained, with these seals preventing undesired communication between the ambient atmosphere and the interior of the well head assembly.

The well head assembly is characterized by the first flange having an interior cylindrical surface, and a longitudinal interior section of the first casing therebelow tapering downwardly and inwardly. The second flange includes a number of circumferentially spaced first threaded bores that extend upwardly from the lower surface thereof, and a number of second threaded bores that extend downwardly from the upper surface of the second flange. The first and second bores are axially aligned but of different diameters, and at their junction define first circular body shoulders.

A first rigid ring is provided that is disposed in the annulus space between the tapered section of the first casing and the external surface of the second casing, with the ring having top and bottom surfaces, an outer side wall that tapers downwardly and inwardly at substantially the same angle as the first section, and an inner side wall. A number of circular, spaced, recesses extend inwardly from the outer side wall of the first ring, and a second circular recess is defined in the first ring that extends downwardly from the top surface and forms a part of the inner side wall. The second recess terminates at the bottom in a second body shoulder.

A number of first sealing rings are provided that are removably mounted in the first recesses, with these first sealing rings when not compressed projecting outwardly from the first recesses. A number of second sealing rings are disposed in the second recess and are stacked one above the other, with the second rings being in abutting contact, and the second rings when not compressed projecting outwardly from the second recess. A second rigid ring is disposed in the annulus space, with the second ring of inverted L-shaped transverse cross-section and including a first horizontal leg and a second vertical leg. The free end of the first leg is in sliding contact with the cylindrical surface, and the free end of the second leg bears against the uppermost one of the second sealing ring.

A number of elongate rigid force exerting members of circular transverse cross-section are provided, that have first and second ends, with a first longitudinal section of each of the members adjacent the first end having threads defined thereon that engage the first threaded bores, and a second longitudinal section of each of the members adjacent the second end having a number of pairs of wrench engageable flat faces formed thereon. A number of externally threaded bushings are mounted in the second threaded bores, which bushings have the force exerting members extending upwardly therethrough, with the bushings including upper end portions on which a number of pairs of wrench engageable faces are defined.

Third sealing rings are disposed in the second threaded bores and encircle the members, with the third sealing rings being forced into sealing contact with the first body shoulder when the bushings are rotated in a direction to be moved downwardly in the second threaded bores. When the elongate members are rotated, the lower ends thereof exert a downward force on the second leg of the second sealing ring which force is transferred through the first leg to the uppermost one of the second resilient rings, with the resilient rings being compressed longitudinally and deforming laterally into sealing contact with the external diameter of the second casing, the inner side wall, and the second body shoulder.

The downward force exerted on the second sealing rings is transferred through the second ring to the first sealing rings to move the latter downwardly relative to the tapered section of the first casing.

From the above description, it will be seen that when the elongate rigid force exerting members are rotated in a first direction, that the second ring is moved downwardly to compress the second resilient rings into pressure sealing contact with the external surface of the second casing which is the primary seal, and concurrently the force exerted on the second sealing rings is transferred through the second ring to the first sealing rings that are moved downwardly to slidably and sealingly engage the tapered section of the first casing. Thus, the first and second sealing rings are placed in sealing engagement by a single actuating mechanism disposed exteriorly on the geothermal well head assembly which permits a single adjustment to be made to place the first and second rings concurrently in sealing contact with exterior surface of the second casing and the tapered surface of the first casing to prevent communication between geothermal fluid within the assembly and the ambient atmosphere.

BRIEF DESCRIPTION OF THE DRAWINGS

FIG. 1 is a side elevational view of a geothermal well head assembly that includes the present invention;

FIG. 2 is a transverse cross-sectional view of the well head assembly taken on the line 2—2 of FIG. 1; and FIG. 3 is a fragmentary vertical cross-sectional view of the primary and secondary seal within the geothermal well head assembly and taken on the line 3—3 of FIG. 2.

DESCRIPTION OF THE PREFERRED EMBODIMENT

In FIG. 1 a geothermal well head assembly A is shown that includes a first flange 10 that is secured to the upper extremity of a first surface string of casing 12 that extends downwardly in a bore hole 14 and enveloped on the exterior surface thereof by a layer of cement 16. The bore 14 extends downwardly to a geothermal zone (not shown). A spool C is provided as shown in FIG. 1 that has a second flange 18 on one end and a third flange 20 on the opposite end. A valved manifold B is provided to control the flow of heated fluid from bore hole 14, which manifold has a fourth flange 22 on the lower end thereof. A number of bolts 24 are provided, with the bolts serving to secure the second flange 18 to the first flange 10 and the fourth flange 22 to the third flange 20 as can be seen in FIG. 1.

A second casing 26 is provided that has an external surface that is of substantially smaller diameter than the interior diameter of the first casing 12. The second casing 26 is concentrically disposed within the confines of the first casing 12, with the second casing extending downwardly to the geothermal zone (not shown), and the lower end of the second casing preferably being held in a fixed position relative to the geothermal zone by a suitable anchor or the like (not shown).

The first flange 10 has a cylindrical interior surface 28 and a downwardly and inwardly tapering surface 30 being defined on the interior of the first casing directly below the cylindrical surface 28 as may best be seen in FIG. 3.

The second flange 18 as may be seen in FIG. 3 has a number of circumferentially spaced first threaded bores 32 that extend upwardly from the lower surface thereof and are axially aligned with second threaded bores 34 that extend downwardly from the top surface of the flange, and the two bores at their junction defining a first circular body shoulder 36.

A first rigid metallic ring E is provided as may best be seen in FIG. 3 that is located in the annulus shaped space 38 between the tapered surface 30 and the second casing 26. The ring E includes a top surface 40, bottom surface 42, outer side wall 44 that tapers inwardly at substantially the same angle as surface 30, and an inner side wall 46. A number of spaced, circular, first recesses extend inwardly into first ring E from outer side wall 44. A second recess 50 extends downwardly in first recess E from top surface 40, and the second recess terminating at the bottom thereof in a second body shoulder 52.

A number of first sealing rings 54 are mounted in first recess 48 as shown in FIG. 3 and project outwardly therefrom. A number of second sealing rings 56 are mounted in second recess 50 one above the other and also project outwardly therefrom. The degree that the first and second sealing rings 54 and 56 project outwardly must be so selected that when the sealing rings are compressed to have the outer extremities flush with the outer side wall 44 and the lower portion of inner side wall 46 a primary and secondary seal is effected between the first and second casings 12 and 26.

A number of elongate force exerting members B are provided that are of circular transverse cross-section, with each of the members having threads 62 formed thereon as shown in FIG. 3, and the upper ends of the members being formed to define a number of pairs of flat faces 64 that may be removably engaged by a wrench (not shown). A number of cylindrical bushings H are also provided as may be seen in FIG. 3 that have pairs of wrench engageable faces 66 defined on the upper ends thereof, and threads 67 formed on the exterior surface of the bushing therebelow. The bushings H have the force exerting members G extending upwardly therethrough. The threads 67 of the bushings H engage the second threaded bores 34, and the bushings when rotated are capable of exerting a downwardly directed force on sealing rings 68 that rest on the first circular body shoulder 36. The sealing rings 68 when compressed expand radially and effect seals with the first body shoulders 36 and the exterior surfaces of the unthreaded portions of the second bore 34 and in so doing prevent leakage of geothermal fluid from the interior of the assembly A in the space between the first threaded bores 32 and the thread 62 to the ambient atmosphere. The first and second flanges 10 and 18 as is customary have oppositely disposed recesses 70 formed therein that are sealingly engaged by a compressed resilient ring 72 when bolts 26 are tightened.

From the above description it will be seen that when the force exerting members G are sequentially rotated in a direction to move downwardly relative to the second flange 18, that the lower ends of the force exerting members pressure contact the first horizontal legs 58 of the second ring F. A downward force is exerted on the second leg 60 which is transferred to the second sealing ring 56 to compress and radially expand the rings into slidable sealing contact with the exterior surface of the second casing 26. The force exerted on the second sealing ring 56 is transferred to the first rigid ring E to force the latter downwardly relative to tapered surface 30 and the first sealing rings being compressed laterally into pressure sealing engagement with the tapered surface 30. The first sealing rings 54 in cooperation with the tapered surface 30 provide the secondary seal between the annulus space 38 and the ambient atmosphere, as the second casing 26 moves longitudinally relative to the second sealing rings 56 due to variation in temperature of the second casing. The sealing rings 68 and the resilient rings 72 prevent communication between the interior of the spool C and the ambient atmosphere.

The use and operation of the invention has been explained previously in detail and need not be repeated.

What is claimed is:

1. A geothermal well head assembly of the type that includes a first flange on the upper extremity of a first casing that is cemented in and extends down a well bore that is in communication with a heated fluid producing zone, said first flange having a cylindrical interior surface, a spool that includes second and third flanges; a valved manifold that controls the flow of heated fluid from said zone which manifold has a fourth flange on the lower end thereof; a plurality of bolts that removably secure said second flange to said first flange, and said fourth flange to said third flange; a second casing that has an external diameter substantially smaller than the interior diameter of said first casing and concentrically disposed therein, said first and second casing defining an annulus shaped space therebetween, said second casing having an upper end adjacently disposed to said second flange and a lower end that occupies a fixed position relative to said heated fluid producing zone, said first casing having an interior surface directly below said cylindrical interior surface that tapers downwardly and inwardly, said second flange having a plurality of circumferentially spaced transverse bores therein, with each of said bores being at least partially threaded and in communication with the interior of said first casing, the improvement for effecting both a primary and secondary seal between said first and second casings adjacent said first flange by a single manual operation and which primary and secondary seals allow said second casing to expand and contract longitudinally relative to said seal due to variations in the temperature of said second casing without destroying said seal, said improvement comprising:

a. a plurality of first and second resilient sealing rings;

b. a first rigid ring disposed in said annulus space adjacent said tapered surface of said first casing, said first ring having top and bottom surfaces, an outer side wall that tapers downwardly and inwardly at the same angle as said tapered surface, said outer side wall having at least one circumferential recess in which a first resilient sealing ring is disposed and that projects outwardly therefrom when not compressed, and an inner side wall that is partially defined by a second recess that extends downwardly from said top surface and terminates in a body shoulder, said second recess having a plurality of said second resilient rings disposed therein one above the other, and said second resilient rings when not compressed projecting outwardly from said first rigid ring;

c. a second rigid ring disposed in said annulus shaped space above said first rigid ring, said second ring having a first portion that slidably engages said cylindrical surface and a second portion that bears against the uppermost of said second resilient sealing rings;

d. a plurality of elongate force exerting members of transverse circular cross-section that have threads on at least a part of the exterior surfaces thereof that engage said threads in said transverse bores, with said force exerting member when rotated in a direction to move towards said first flange contacting said second ring and moving the latter downwardly, said second portion of said second ring as it moves downwardly bearing against the uppermost of said second sealing rings, said second sealing rings, first ring, and first sealing rings moving downwardly as a unit with said second ring, said first sealing rings being radially compressed into sealing engagement with said tapered surface as said outer side wall of said first ring moves downwardly relative thereto, said second sealing rings being radially deformed inwardly into slidable sealing contact with the exterior surface of said second casing by the downward force exerted thereon by said second portion of said second ring, and said first sealing rings at maximum compression when said outer side wall is in abutting contact with said tapered surface of said first casing.

2. A geothermal well head assembly improvement as defined in claim 1 in which said second rigid ring is of inverted L-shaped transverse cross-section and includes a first horizontal leg and a second vertical leg that has a flat lower extremity of substantially the same width as that of said second recess, said first leg in slidable engagement with said cylindrical surface, and said flat lower extremity bearing against the uppermost of said second sealing rings.

* * * * *

UNITED STATES PATENT AND TRADEMARK OFFICE

CERTIFICATE OF CORRECTION

PATENT NO. : 4,327,804

DATED : May 4, 1982

INVENTOR(S) : Lehman T. Reed

It is certified that error appears in the above-identified patent and that said Letters Patent is hereby corrected as shown below:

On the title page

ITEM [75] SHOULD READ:

--LEHMAN T. REED--

Signed and Sealed this

*Eleventh* Day of *June 1985*

[SEAL]

*Attest:*

DONALD J. QUIGG

*Attesting Officer*

*Acting Commissioner of Patents and Trademarks*